US011405719B2

(12) United States Patent
Avalos

(10) Patent No.: US 11,405,719 B2
(45) Date of Patent: Aug. 2, 2022

(54) ARCHITECTURAL SPEAKER TUNING SYSTEM

(71) Applicant: Edward Avalos, Colfax, CA (US)

(72) Inventor: Edward Avalos, Colfax, CA (US)

( * ) Notice: Subject to any disclaimer, the term of this patent is extended or adjusted under 35 U.S.C. 154(b) by 241 days.

(21) Appl. No.: 16/879,266

(22) Filed: May 20, 2020

(65) Prior Publication Data

US 2021/0368259 A1 Nov. 25, 2021

(51) Int. Cl.
*H04R 1/28* (2006.01)

(52) U.S. Cl.
CPC ..... *H04R 1/2888* (2013.01); *H04R 1/288* (2013.01); *H04R 2201/021* (2013.01)

(58) Field of Classification Search
CPC .. H04R 2201/021; H04R 1/025; H04R 1/026; H04R 1/28; H04R 1/2803; H04R 1/2869; H04R 1/2873; H04R 1/2876; H04R 1/288
See application file for complete search history.

(56) References Cited

U.S. PATENT DOCUMENTS 3,912,865 A * 10/1975 Seebinger ..... H04R 1/025 381/124
2018/0227652 A1* 8/2018 Foster ..... H04R 1/026

* cited by examiner

*Primary Examiner* — Kile O Blair

(57) ABSTRACT

The Architectural Speaker Tuning System is a sand-filled plastic reinforcing sub-baffle for an architectural custom installed loudspeaker mounted in drywall paneling. The mechanical acoustical resonance of the drywall distorts the sound of the custom loudspeaker. The speaker tuning system shifts drywall resonance to a more suitable frequency. The sand-tuned result revives the fidelity of the loudspeaker. The sub-baffle shipped empty, filled with sand provided by the installer, installs through the loudspeaker drywall panel cut-put, and adheres to the rear of the drywall. The custom loudspeaker is then inserted and clamped to the sub-baffle system.

1 Claim, 9 Drawing Sheets

Layout of the four quartered in-ceiling sub-baffle hulls

FIG #1A
Layout of the four quartered in-ceiling sub-baffle hulls
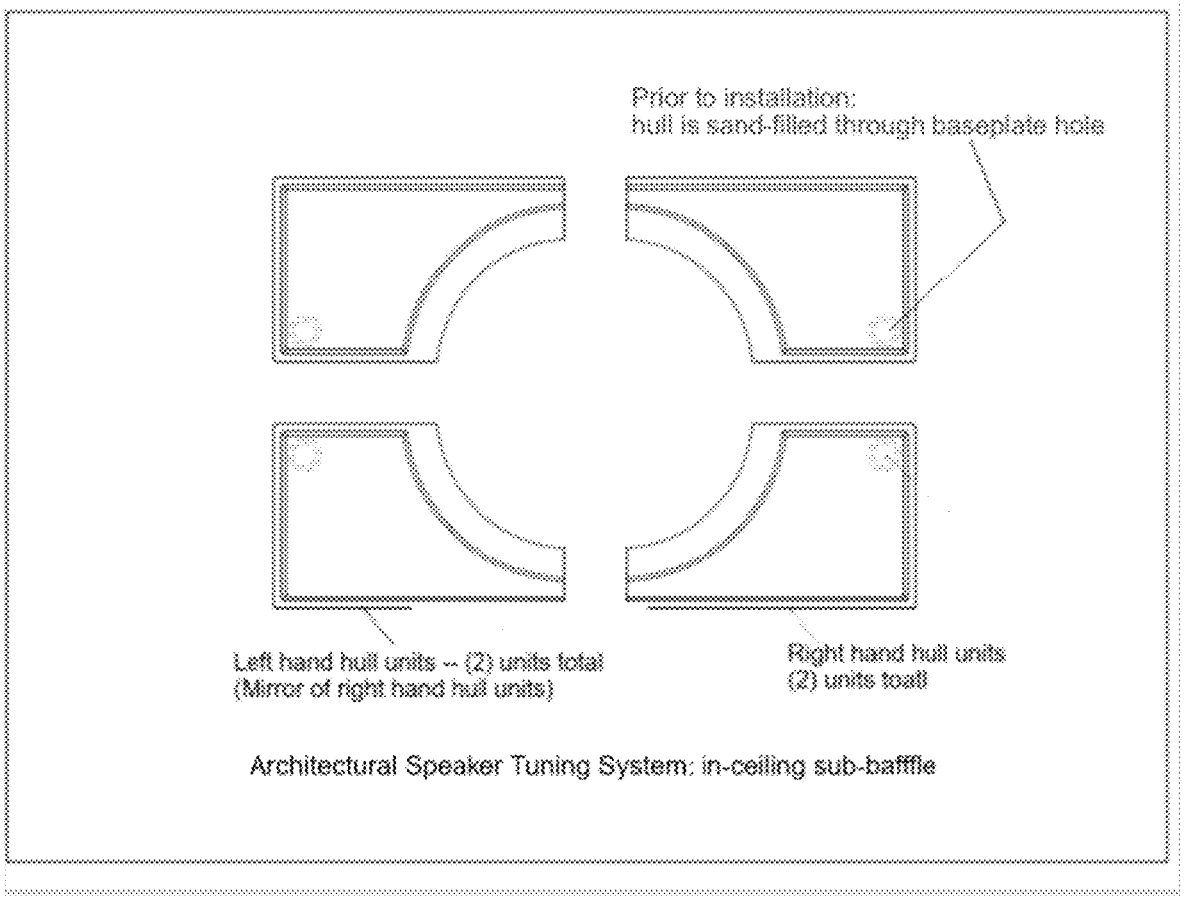

FIG # 1B
The in-ceiling sub-baffle quartered hull.
The drawing represents the in-ceiling sub-baffle top right and the bottom left hull.
The top left and the bottom right hulls are mirror images of figure #1B.
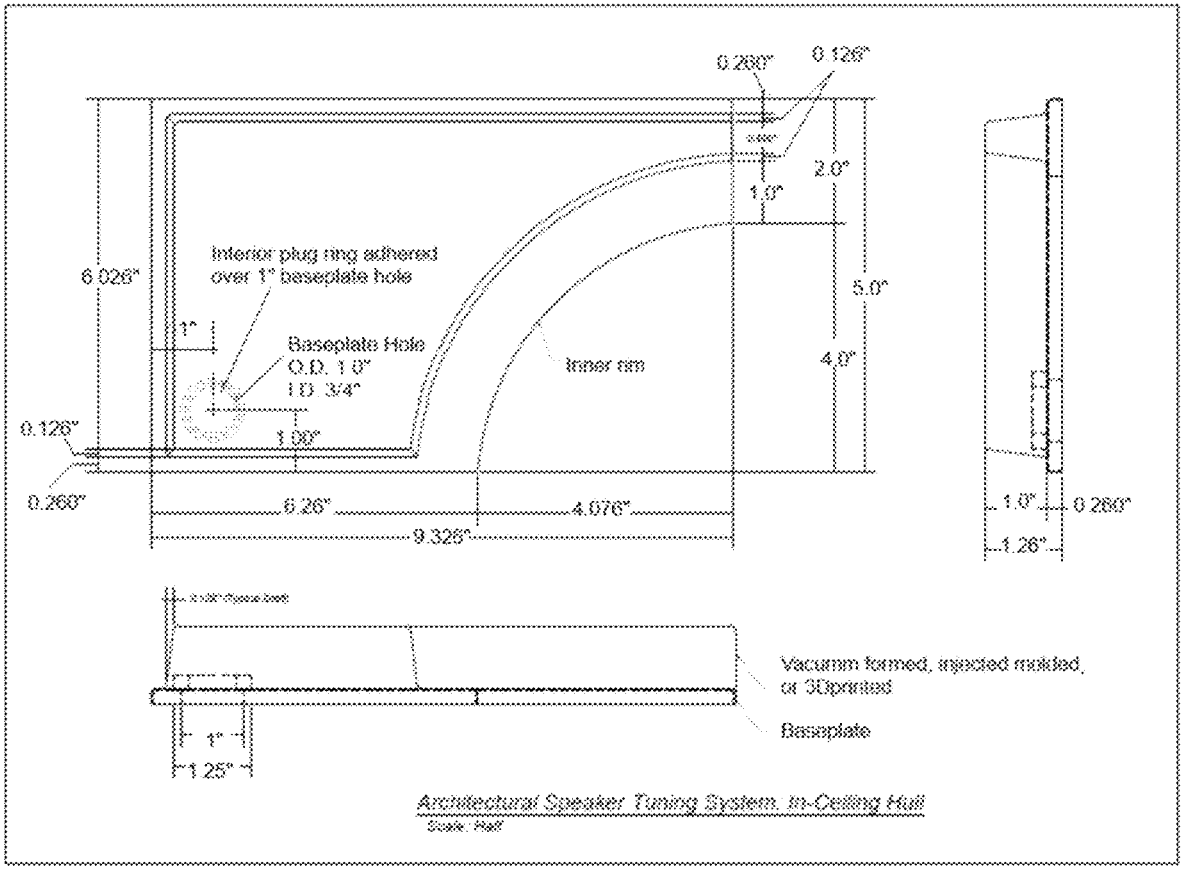

FIG # 1C
Layout of the four quartered in-ceiling sub-baffle hulls.
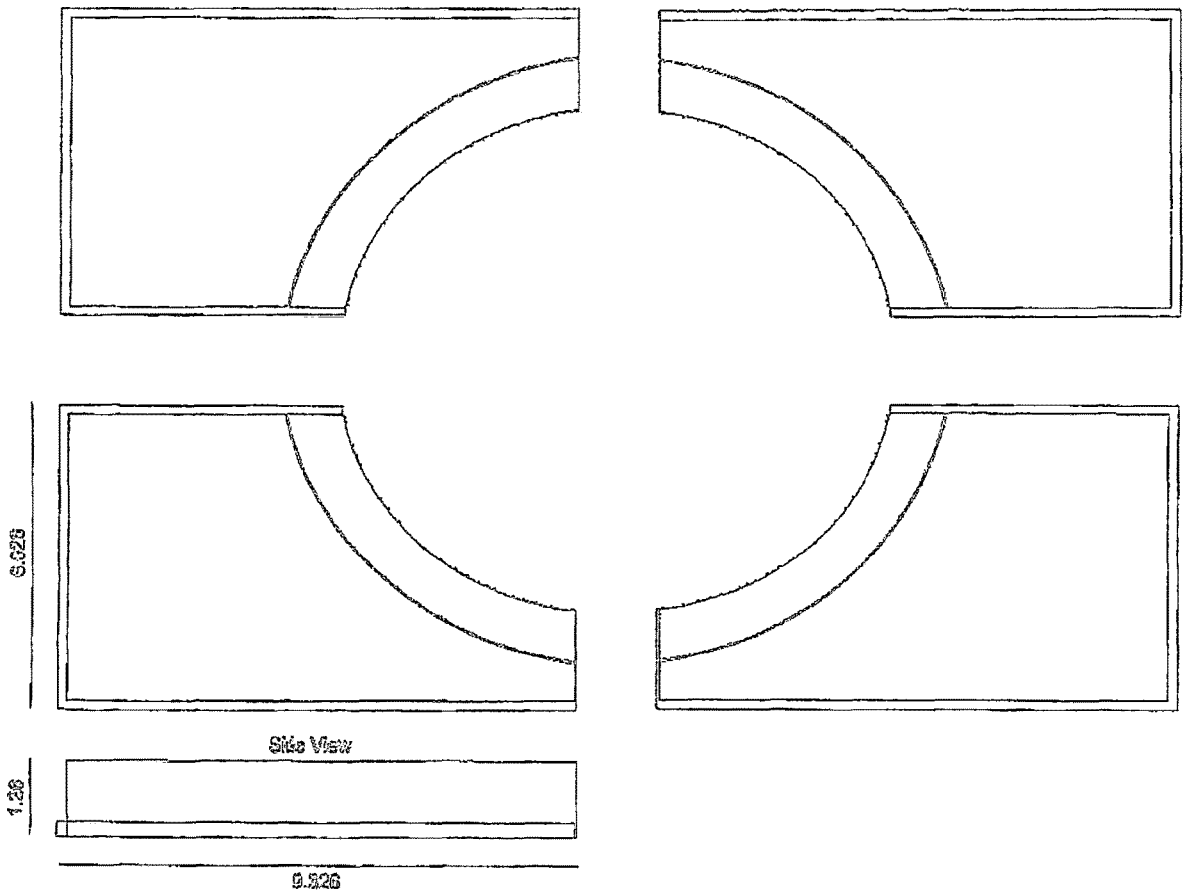

FIG #2A
Layout of the four quartered in-wall sub-baffle hulls
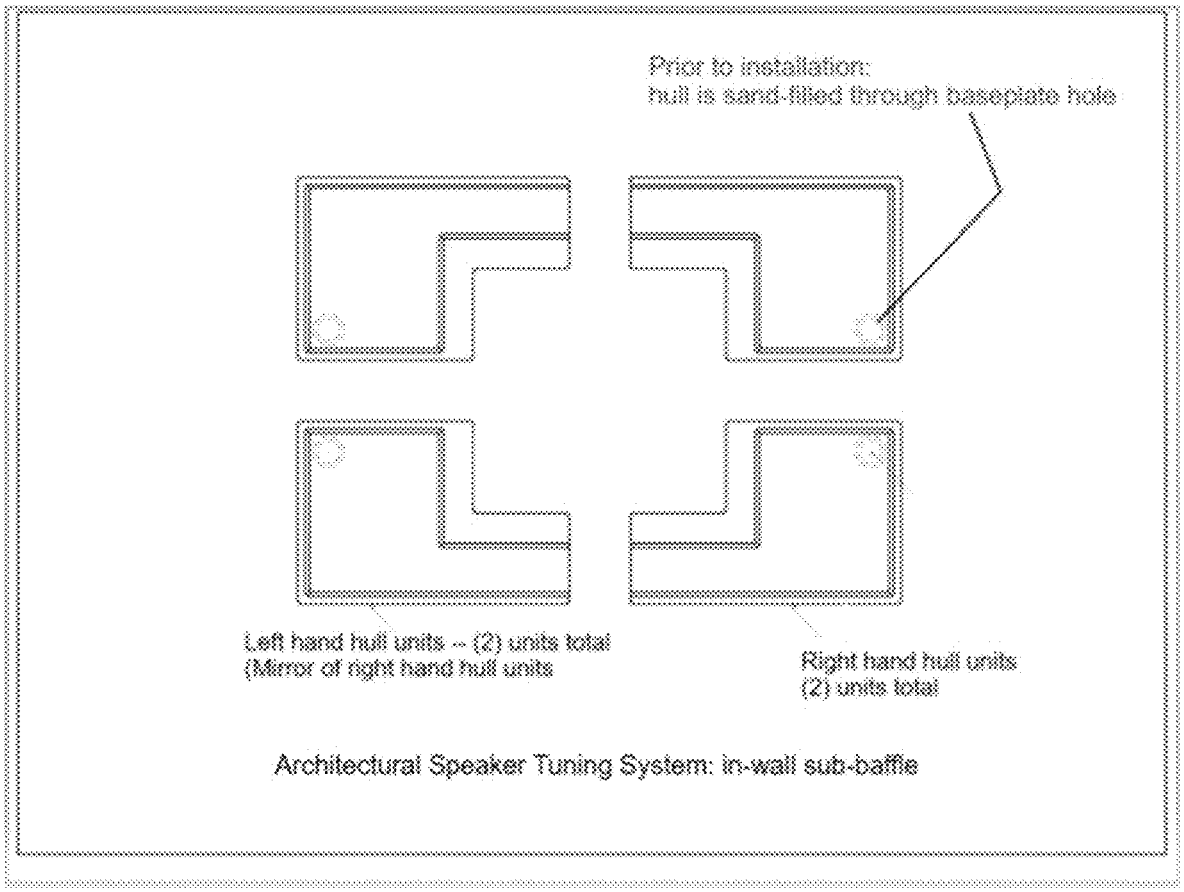

FIG # 2B
This drawing represents the in-wall sub-baffle top and the bottom left hull.
The top left and bottom hulls are mirror images of figure #2B
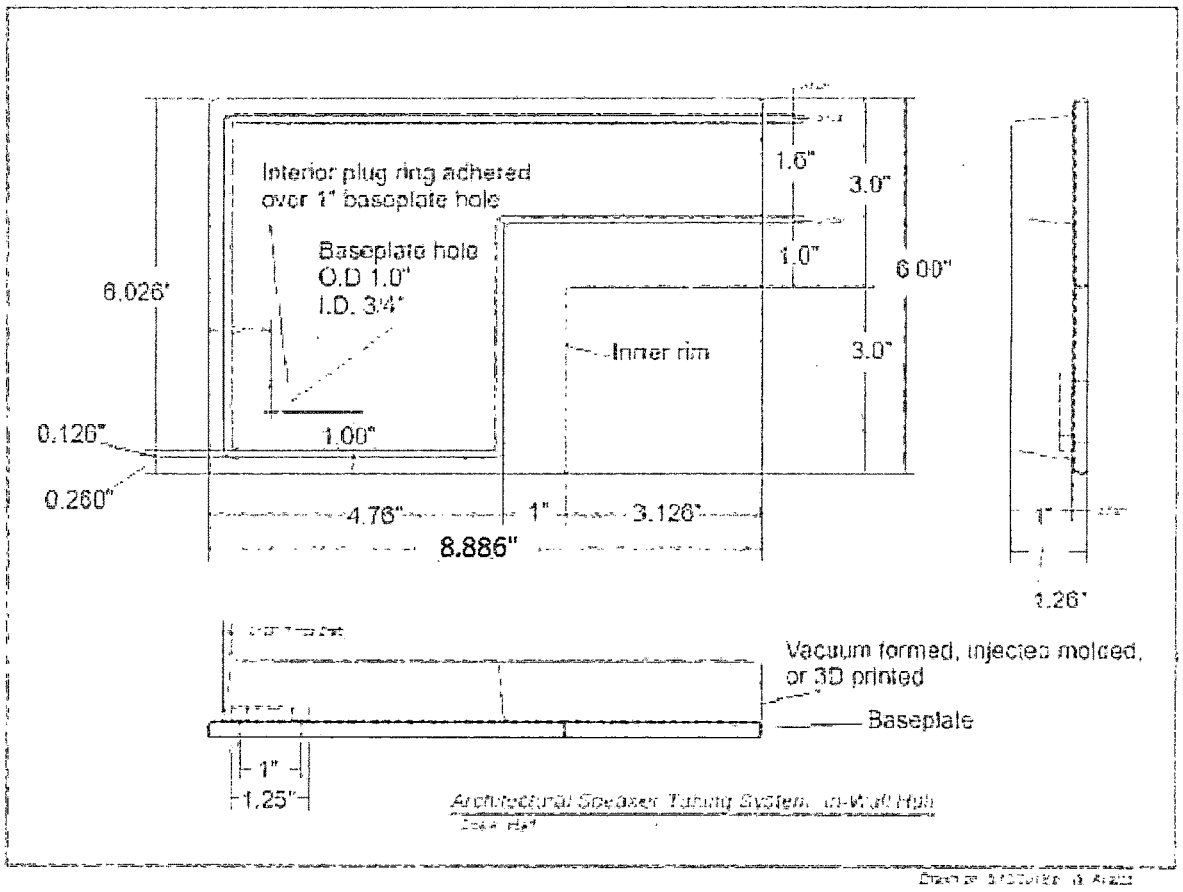

FIG # 2C
Layout of the four quartered in-wall sub-baffle hulls.
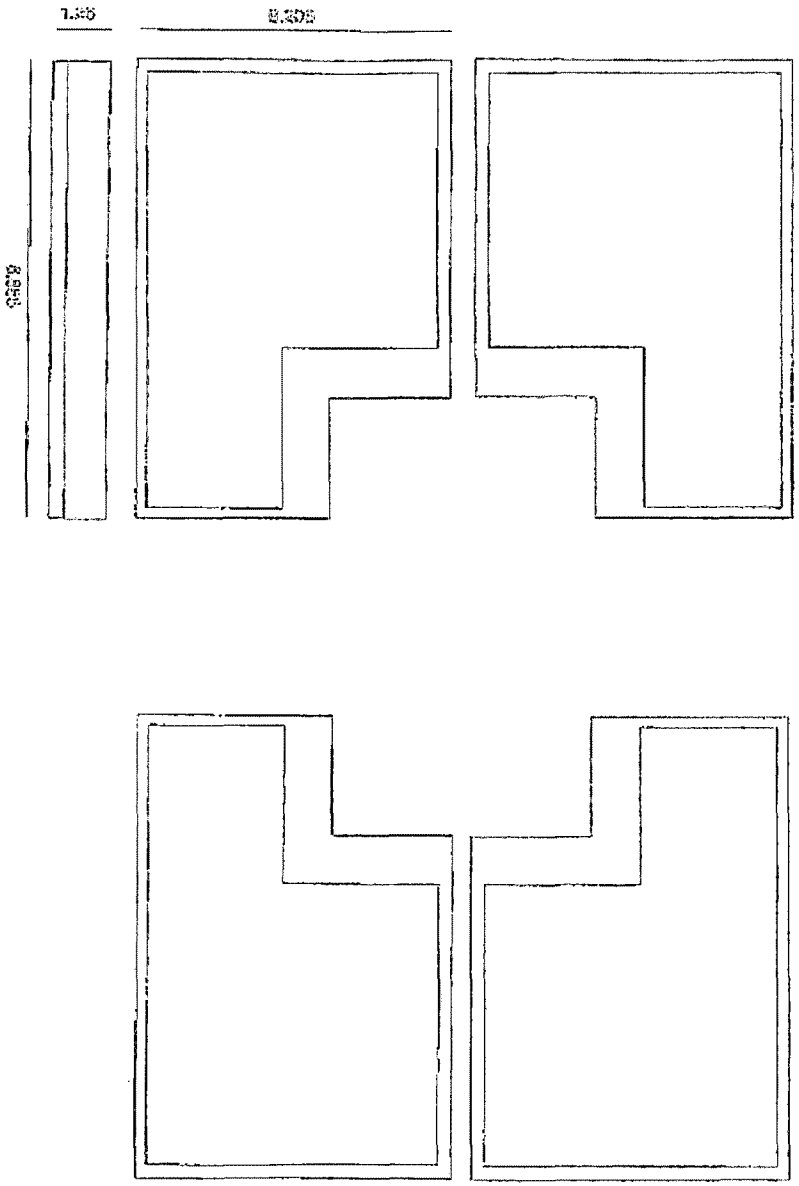

FIG #3A

Drywall mounted custom speaker without the Architectural Speaker Tuning System.

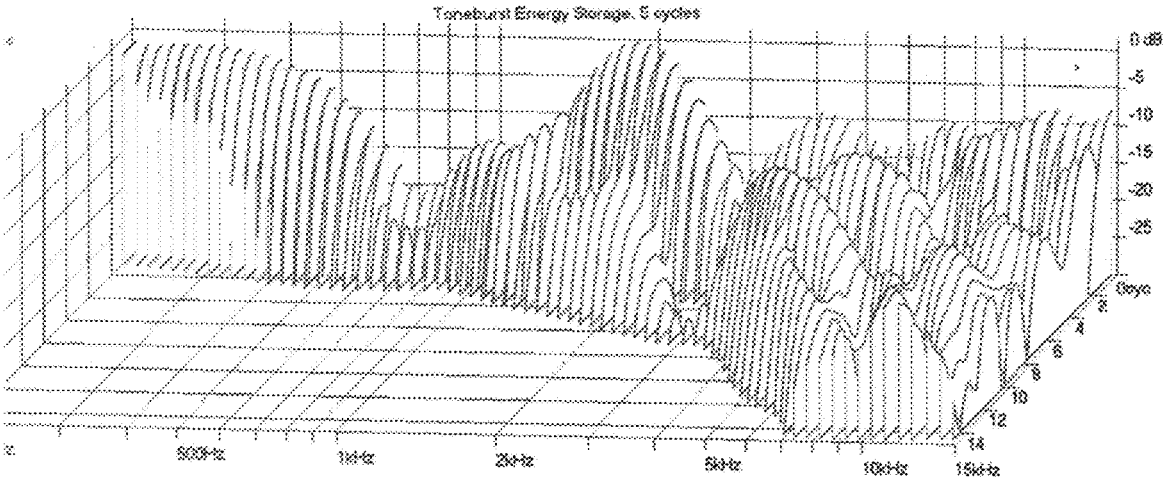

The graph exposes a vast distorting gap with an average 10 db loss from about 600 Hz to 1.5 kHz of a Paradigm P65-R custom in-ceiling speaker mounted in an infinite baffle drywall enclosure. The gap is the result of distorting out-of-phase drywall resonance. Drywall resonance distorts the core of music and movie soundtracks.

FIG #3B
Drywall mounted custom speaker with the Architectural Speaker Tuning System.
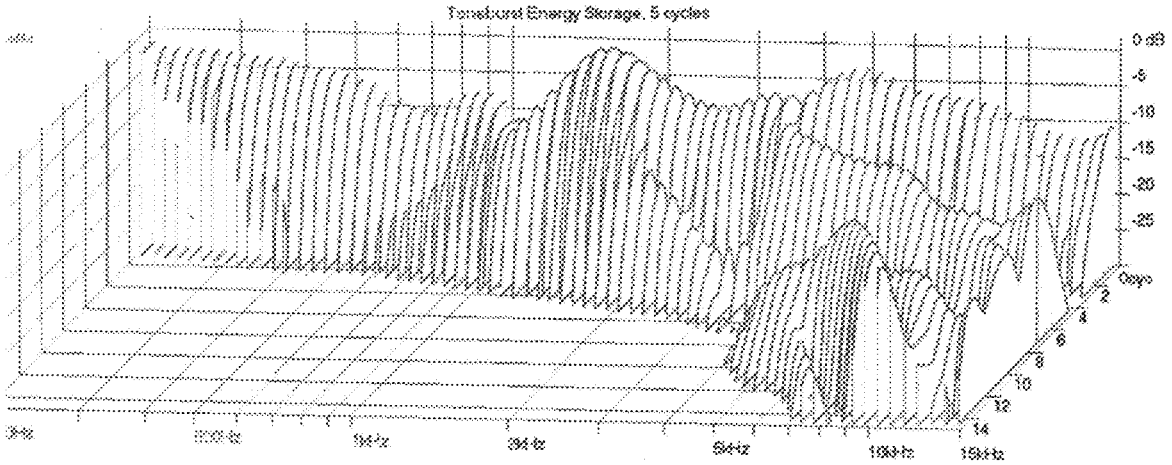
This graph illustrates the result of the Architectural Speaker Tuning System reviving the previously cited Paradigm custom in-ceiling speaker. It reversed the distorting effects of drywall resonance.

FIG #4
Installation Sketch
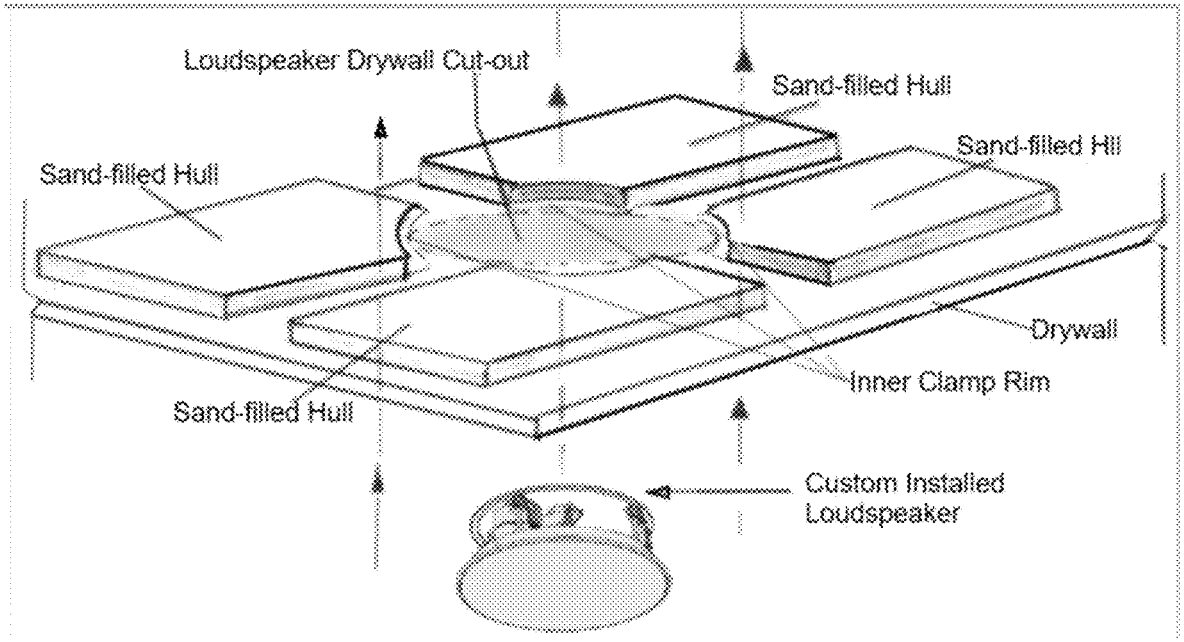

ARCHITECTURAL SPEAKER TUNING SYSTEM

CROSS-REFERENCE TO RELATED APPLICATIONS

"Not Applicable"

STATEMENT REGARDING FEDERALLY SPONSORED RESEARCH OR DEVELOPMENT

"Not Applicable"

REFERENCE TO SEQUENCE LISTING, A TABLE, OR A COMPUTER PROGRAM LISTING COMPACT DISC APPENDIX

"Not Applicable"

BACKGROUND OF THE INVENTION

The architectural loudspeaker industry offers an abundance of acoustical and mechanical solutions. The Architectural Speaker Tuning System is a solution that addresses the corrupted phase and distorted frequency response generated by an architectural custom installed loudspeaker mounted in drywall paneling. It also tackles associated installation and shipping issues. The following patents cover associated topics:

U.S. Pat. Nos. 7,032,708B2 and 7,540,460B2 address speaker mounting and vibration.

JPS594400A addresses speaker mounting fixtures.

U.S. Pat. No. 8,985,268B2, JPH0511682U, and GB1426568 address the use of sand in speaker cabinets.

BRIEF SUMMARY OF THE INVENTION

The Architectural Speaker Tuning System is a sand-filled reinforcing sub-baffle for a custom installed loudspeaker mounted in drywall paneling. The resonant frequency of the drywall distorts the sound of the custom loudspeaker. The Architectural Speaker Tuning System shifts distorting drywall resonance to a more suitable frequency. The sand-tuned result revives the fidelity of the loudspeaker. The speaker tuning system sub-baffle is shipped empty, filled with sand provided by the installer, and installed through the custom loudspeaker drywall cut-out. The custom loudspeaker is then inserted and clamped to the sub-baffle system.

BRIEF DESCRIPTION OF THE SEVERAL VIEWS OF THE DRAWING

FIG. 1A Drawing of the in-ceiling sub-baffle system.

FIG. 1B Drawing of the in-ceiling sub-baffle hull.

FIG. 1C Drawing of the in-ceiling sub-baffle system.

FIG. 2A Drawing of the in-wall sub-baffle system.

FIG. 2B Drawing of the in-wall sub-baffle hull.

FIG. 2C Drawing of the in-wall sub-baffle system.

FIG. 3A Graph of the audio measurements without the sub-baffle.

FIG. 3B Graph of the audio measurements with the sub-baffle.

FIG. 4 Architectural Speaker Tuning System installation sketch.

DETAILED DESCRIPTION OF THE INVENTION

The management of resonance is an essential element of loudspeaker engineering. Loudspeaker resonance is the mechanical-acoustical vibration of a frequency produced in response to an identical stimulus frequency. Undesired resonance audibly distorts the phase and the frequency response of a loudspeaker system.

Mounting a loudspeaker to a rigid loudspeaker cabinet baffle is the initial fundamental method of managing loudspeaker system resonance. Utilizing a rigid cabinet baffle for a custom in-wall or in-ceiling loudspeaker installation is typically avoided due to cost. A common compromised practice is to install the custom loudspeaker into drywall paneling. However, the resonance of the drywall paneling audibly distorts the phase and the frequency response of the loudspeaker system.

The Architectural Speaker Tuning System offers an alternative that confronts three issues:

1. The resonance of drywall distorts the sound of an architectural custom installed loudspeaker mounted in drywall paneling.
2. Obstructed access to the rear of a wall or ceiling increases installation time and cost.
3. The primary element of shipping costs is weight. Shipping cost significantly affects product pricing.

The Architectural Speaker Tuning System is a sand-filled plastic reinforcing sub-baffle for an architectural custom installed loudspeaker mounted in drywall paneling. Manufacturing the system plastic sub-baffle can employ vacuum molding, injection molding, or 3D printing.

The speaker tuning system sub-baffle comprises two versions: the in-ceiling model (FIG. 1A) and the in-wall model (FIG. 2A). Both versions are quartered and manufactured as four hollow plastic hulls (FIG. 1B, 2B). The hulls are shipped empty and filled with sand provided by the installer via the interior base plate plug-ring-hole shown in FIGS. 1B and 2B. The plug ring seals the hull.

The four sand-filled plastic hulls install through a custom loudspeaker drywall panel cut-out held in place on the rear of the drywall with an adhesive. The custom speaker is then inserted and clamped to the inner rim of the sub-baffle (FIG. 4).

The mass-loaded-sand revives the fidelity of the custom installed loudspeaker as it re-tunes distorting drywall panel resonance to a more suitable frequency (FIG. 3A, 3B). Easy access provided by quartering the sub-baffle minimizes installation time and cost (FIG. 4). The 'ship-empty and fill with sand provided by the installer' element significantly reduces shipping cost and system pricing.

The invention claimed is:

1. An Architectural Speaker Tuning System to manage the resonance of an architectural custom installed loudspeaker mounted in drywall paneling comprising:

a plastic loudspeaker sub-baffle;

wherein the plastic loudspeaker sub-baffle is quartered and manufactured as four hollow plastic hulls;

wherein each of the four hollow plastic hulls is adapted to be filled with sand;

wherein the plastic loudspeaker sub-baffle is installed through a custom installed loudspeaker drywall cut-out which accommodates inserting and clamping the custom installed loudspeaker to the sub-baffle.

* * * * *